United States Patent [19]

Mott

[11] 4,069,681

[45] Jan. 24, 1978

[54] OFFSHORE STRUCTURE FOR DELTAIC SUBSTRATES

[75] Inventor: George E. Mott, Metairie, La.

[73] Assignee: Texaco Inc., New York, N.Y.

[21] Appl. No.: 654,135

[22] Filed: Feb. 2, 1976

[51] Int. Cl.[2] ..... F02D 25/02; E02B 17/00

[52] U.S. Cl. ..... 61/89; 61/44

[58] Field of Search ..... 61/46, 46.5, 86, 87, 61/88, 89, 94, 98, 99; 114/264, 265

[56] References Cited

U.S. PATENT DOCUMENTS

| | | | |
|---|---|---|---|
| Re. 24,180 | 7/1956 | Parks | 61/46 |
| 2,580,911 | 1/1952 | Harris | 61/46.5 |
| 2,589,146 | 3/1952 | Samuelson | 61/46.5 |
| 2,924,947 | 2/1960 | Peterson | 61/46.5 |
| 2,938,353 | 5/1960 | Vorenkamp | 61/46.5 |
| 2,941,369 | 6/1960 | Quirin | 61/46.5 |
| 3,434,293 | 3/1969 | Brown | 61/46.5 |
| 3,496,900 | 2/1970 | Mott et al. | 61/46.5 |
| 3,717,001 | 2/1973 | Tam | 61/46.5 |

*Primary Examiner*—Paul R. Gilliam
*Assistant Examiner*—Alex Grosz
*Attorney, Agent, or Firm*—Thomas H. Whaley; Carl G. Ries; Robert B. Burns

[57] ABSTRACT

A submergible offshore structure capable of being floated by a buoyant hull, to a subsea working site. An anchoring system incorporated into the structure includes a plurality of elongated caisson-like legs which are guidably moved vertically into and out of the structure. Said legs are adapted to be embedded and firmly fixed in a relatively soft substrate. Thus, they function to guide the submergible structure to its underwater position, and to maintain it there during a period of operation.

9 Claims, 6 Drawing Figures

OFFSHORE STRUCTURE FOR DELTAIC SUBSTRATES

BACKGROUND OF THE INVENTION

In many deltaic areas of the world the ocean bottom is formed very rapidly by river silt deposits which accumulate, and which can exceed a build-up of as much as a foot per year. As a result of the rapid deposition rate and the fine particles being deposited, sections of the deposits are underconsolidated and remain in a flocculated condition. Further, such build-ups are characterized by very high water content and very low strength.

When deposits of this nature are acted upon by pressure differentials such as those caused by large waves, the soft materials often slide down the Continental Shelf, thereby forming a slide channel. Such a slide is similar in many respects to a river channel. The channel can be several hundred, or even thousands of feet wide, more than 100 feet deep, and extend for its length over several miles. Further, these slides tend to occur in water depths up to 200 to 300 feet due to the normal reduction of wave pressure with water depth.

Conventional offshore fixedly positioned drilling and production platforms, and similar fixed marine structures will not resist the loss of the horizontal soil support coupled with the very high lateral loads which result from the above noted sliding mass of soil. From experience, it is known that several marine platforms and ocean floor pipelines have been destroyed. These were experienced in the Gulf of Mexico as well as in other areas of the world.

The invention in brief therefore contemplates a marine structure or platform that is capable of being floated to an offshore working site, and thereafter being controllably submerged to the ocean floor. The floatable structure includes a plurality of support or foundation members that function when in the extended position, to firmly anchor the floatable unit at a working site. This is true particularly in an unconsolidated substrate which comprises essentially a deltaic or similar composition that does not readily support an appreciable amount of weight. The foundation or caisson members are capable of being individually embedded into the ocean floor. This is achieved through the combination of a jetting system, a vacuum, or pump system, and by applying weights to the top of each caisson.

An object of the invention therefore is to provide a marine structure having deeply embeddable support or foundation members which will firmly maintain the unit at a submerged working position.

A further objective is to provide a marine structure capable of being accurately lowered to the ocean floor through the use of self contained guiding and foundation members.

A still further object is to provide a marine structure of the type contemplated including a plurality of self embedding legs or caisson-like foundation members that are conveyed on the structure and which serve to guide the unit to a working site at the ocean floor. They thereafter maintain it in place for drilling and producing operations.

A marine structure of the type presently contemplated is in some respects similar to a jack-up type unit. It is one that comprises essentially a floatable member having a plurality of suppport legs, which depend downwardly therefrom. The legs are normally operably engaged with means which permit said legs to be controllably lowered or raised with respect to the floatable member.

Operationally, the conventional jack-up type offshore unit is normally towed to a working site with the support legs extending above the water. At the site, the support legs, which exceed the water depth, are lowered until they reach a support point at or immediately beneath the ocean floor.

At such time as the respective legs have been lowered to a point where they are firmly supported by the substrate, the jacking mechanism on the floating hull section is actuated. This allows the hull to climb to a desired working height along the legs. The climbing step is continued until the hull reaches a preferred distance above the water's surface which would allow a drilling or producing operation, as the case may be.

Figure 1:
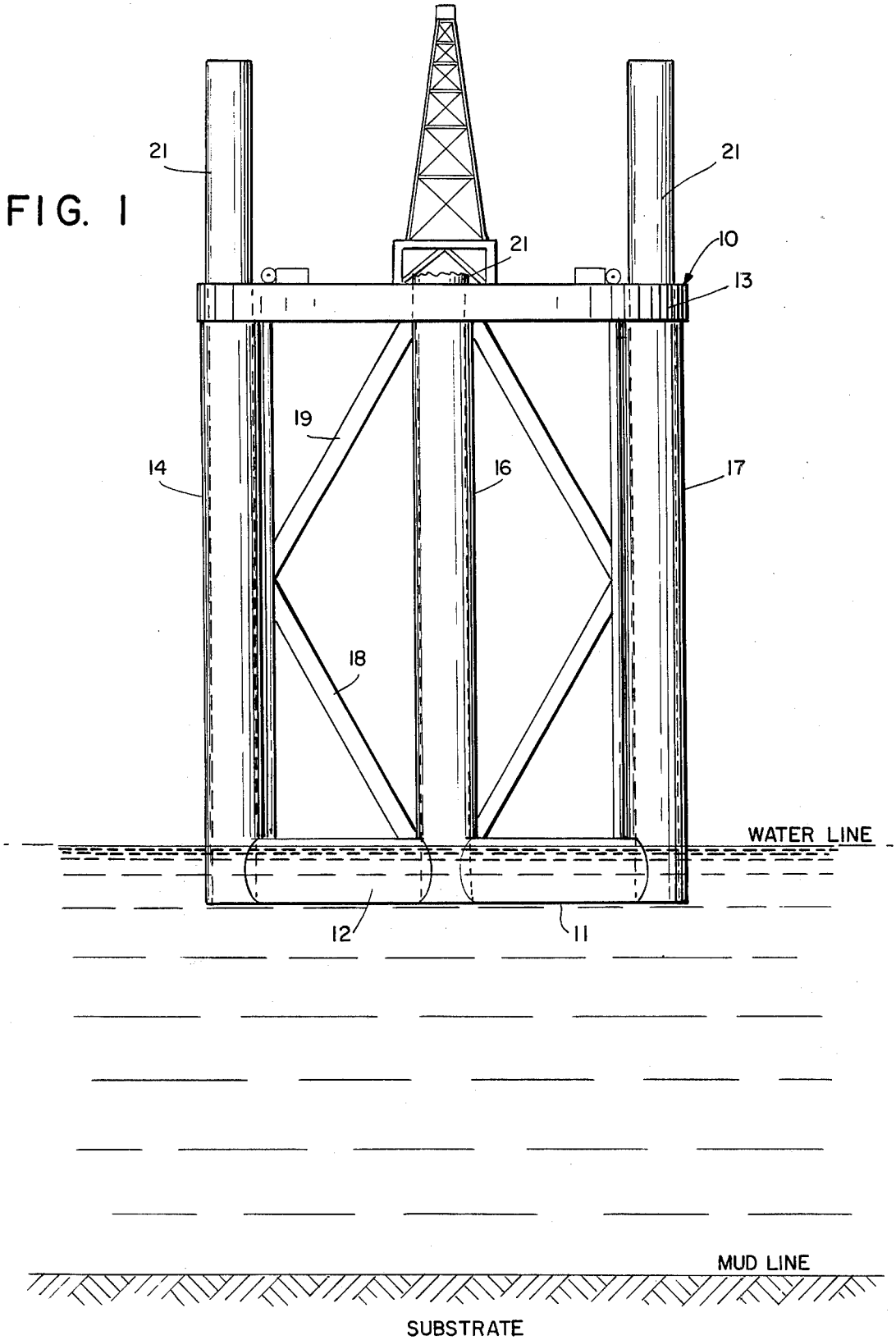
FIG. 1 is an elevation view of the disclosed vessel in a floating position in a body of water.

In the present instance and referring to FIG. 1, the marine structure or vessel 10 includes a floatable hull 11 which can be comprised of a single hull unit, or of a plurality of individual hull members or pontoons 12. The latter can be appropriately formed and interconnected with bracing and the like, to provide the hull with the required degree of seaworthiness. While not specifically here shown, hull 11 can be further provided with upstanding buoyancy control members or columns. The latter normally include buoyancy tanks which depend from the hull, and which function to maintain the latter's stability particularly when in a partially submerged condition.

A deck 13 is positioned above hull 11 a sufficient distance to be beyond the water's surface when the hull is resting on the ocean floor. Said deck 13, in the normal manner accommodates the material and equipment required for the vessel's operation. In the instance of a drilling vessel the unit will carry the usual derrick, pumps, pipe supplies, crews' quarters and the like.

Deck 13 as shown in FIG. 1, is supported at a fixed elevated position above hull 11. The support means includes a superstructure constituted of a series of upstanding columns 14, 16 and 17. The latter are spaced about the vessel in such an arrangement to insure both structural and seaworthy integrity. The upstanding superstructure columns can be further reinforced and braced by laterally disposed interconnectors 18 and 19. The latter will be provided to the extent needed to meet strength and rigidity requirements of the unit.

Toward providing the vessel with floating stability particularly while being submerged, and as herein mentioned, one or more columns in the superstructure can be provided with controlled buoyancy means such as the usual tanks and piping system. Said stabilizing means, together with the hull, are capable of controllably regulating the disposition of vessel 10 under all conditions. However, at least three of said upright columns serve primarily as guide members for the vessel's foundation legs 21, as will be hereinafter detailed.

The physical composition of upstanding columns 14, 16 and 17 can comprise a number of configurations including an open work of appropriately positioned structural elements. Said members, cooperatively define therebetween, an internal elongated passage for laterally confining a foundation leg during its vertical movement through the vessel.

Figure 5:
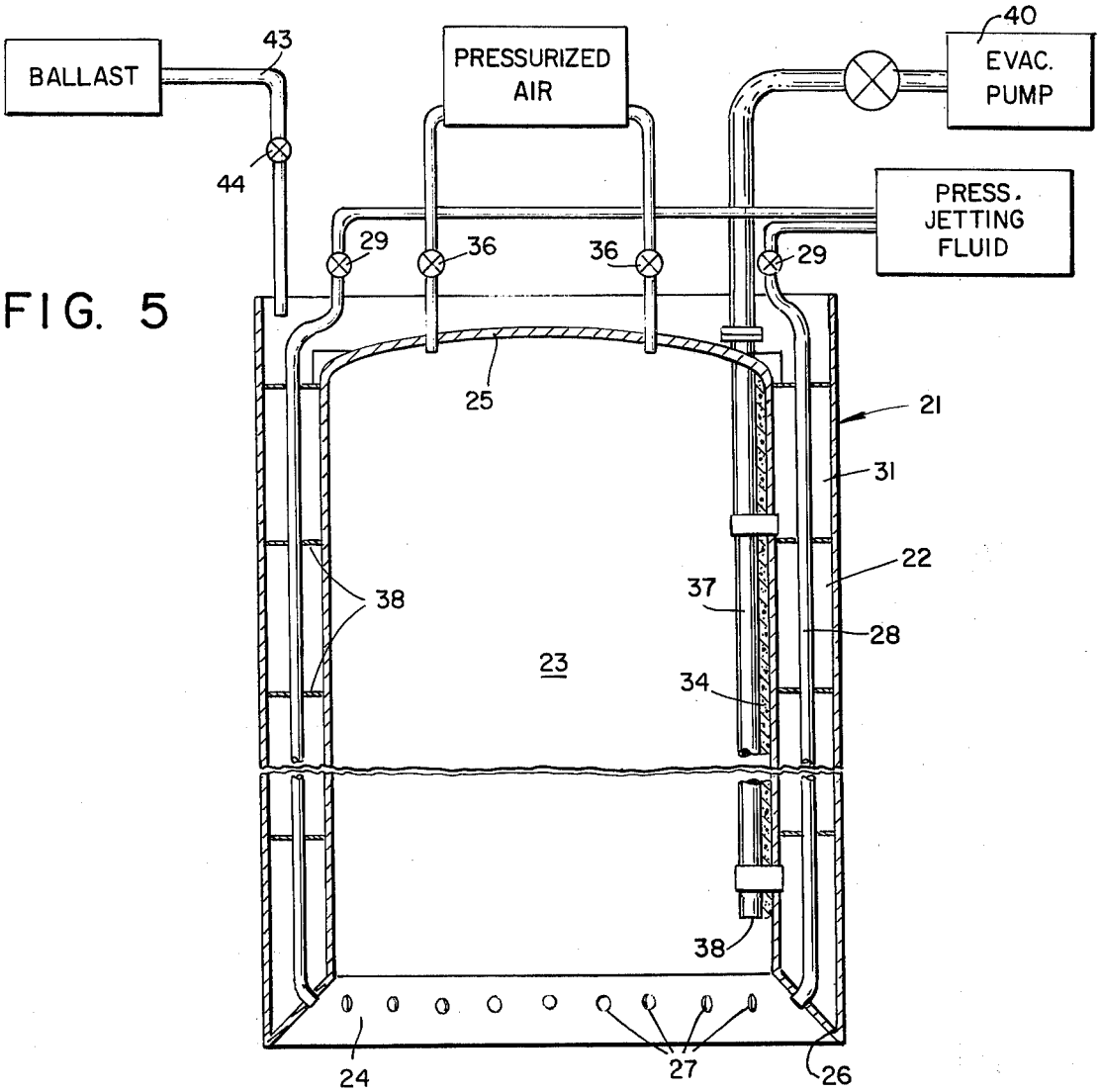
FIG. 5 is a view in cross section showing the embedding caissons.
Figure 6:
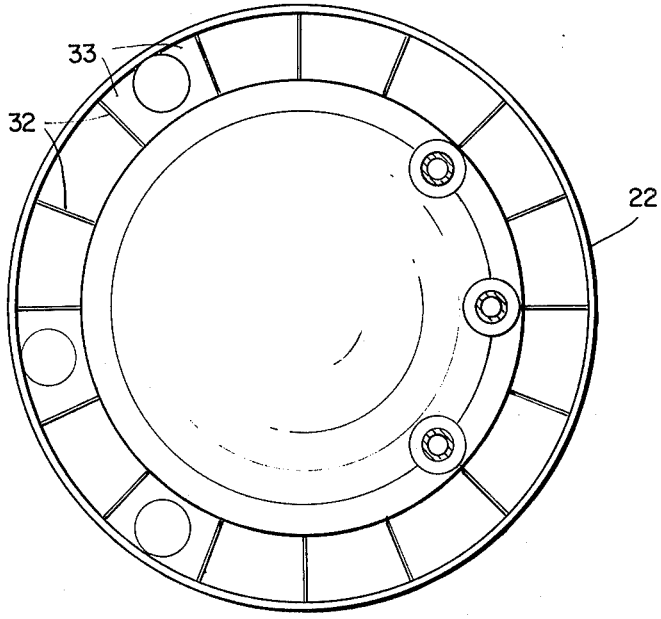
FIG. 6 is a top view of an embedding caisson.

In the present arrangement however, and referring to FIG. 5, foundation leg 21 comprises body 22, formed by an elongated cylindrical member. The single body 22, or the individual segments which make up the body as a whole, define an elongated internal compartment 23. One end of the latter is provided with closure member 25 extending across the top, to in effect define an elongated compartment open at the lower end and closed at the upper end.

The lower end of the leg 21 is provided with a circular entry opening or driving shoe 24 preferably tapered to define a relatively sharp edged lip 26. The walls of foundation leg 21 are formed to provide a fluid tight enclosure within compartment 23 at such time as the lip 26 has been lowered sufficiently to enter the substrate. Said lower edge of lip 26 is further provided with a plurality of apertures 27 that are preferably equispaced about the inner surface of the lip. The apertures are aligned to simultaneously direct a plurality of streams of jetting fluid inwardly and downwardly.

Thus, as the foundation leg is vertically lowered into an unconsolidated substrate, high velocity streams of jetting fluid will be formed by apertures 27. These streams are directed in such a manner to fluidize and soften the substrate immediately beneath and within the leg. Thus the leg 21, by its own weight, can be further embedded into the substrate.

A plurality of fluid carrying conduits 28 extend from the respective apertures 27 at the cutting edge 26, upwardly and through the peripheral walls of the leg to the top surface thereof. These conduits are secured at the bottom to a pressure tight circular chamber formed in the area between the outer caisson wall 22, the driving shoe 24. Said circular chamber is in turn segmented by pressure tight diaphragms into three or more segments, each of which is fed by a conduit 28. Such an arrangement provides a means for selectively adjusting the flow of fluid to the jets 27 at three or more peripheral areas around each caisson.

The respective conduits 28 can be connected to a suitable manifold or in the alternative can each be provided with an individual control valve 29. Thus, by regulating the flow of jetting fluid which passes to the various segments of the leg 21, it is possible to deviate the leg's downward movement into a particular direction. The arrangement will further permit correction of an unwanted deviation by altering the flow to the various jetting apertures 27.

As shown, the conduits 28 are contained within the annulus 31 defined by the outer wall of body 22 and an inner shell 34. The latter, similar to body 22, is generally cylindrical in configuration and supported from the contiguous body wall by a plurality of radially extending stiffeners 32 and ring stiffeners 33.

Stiffeners 32 extend substantially the length of the body forming a series of circumferential compartments. The latter can be subsequently ballasted with water or a similar medium to assist in the placement operation of the various legs.

To regulate the buoyancy of foundation leg 21 the cylindrical void space 23 is provided with one or more pipes and valves 36. Said valves are communicated preferably to a source of pressurized air. Thus, air can be forced into the leg or caisson interior in a sufficient amount to regulate the internal pressure and hence the buoyancy of the caissons. Alternatively the caisson can be depressurized to evacuate the fluidized substrate which has been drawn through the open bottom of the caisson as the latter descends.

An elongated discharge line or lines 37 extend substantially the length of leg 21 and include a lower intake opening 38. To effectively withdraw jetting fluid and material from the leg interior the said opening 38 is disposed adjacent to the leg near the lower end of caisson 21. The upper end of discharge line 37 is communicated with a pump or similar means 40 capable of initiating and maintaining a flow of the fluidized substrate from the lower end of the caisson.

Referring to FIG. 1, foundation leg 21 as noted herein is essentially cylindrically shaped, having an elongated outer surface formed by body 22. The leg is slidably received within upstanding column 14 in a manner that the leg can either be retracted upwardly, or extended downwardly from hull 11. When in the retracted position lower edge 24 of leg 21 is disposed essentially at the lower edge of hull 11. Thus, as vessel 10 is being floated to or from a working site the respective foundation legs 21 can be in a retracted or partially extended position. When so positioned and filled with pressurized air, they will effect both the buoyancy of the unit and its stability while being towed particularly in the instance of rough sea conditions.

While not instantly shown in detail, a leg jacking and fastening means can be carried in a convenient location such as on deck 13. It can also be carried at the hull level for the purpose of adjusting the disposition of the elongated foundation leg and securing the same with respect to its guide column 14. During such a period of transportation, leg 21 can be welded or similarly fastened to be rigidly confined within the guide column 14.

Operationally platform 10, as shown in FIG. 1, is normally disposed with the respective foundation legs 21 fully withdrawn into the column 14, becoming an integral part of the latter.

Figure 2:
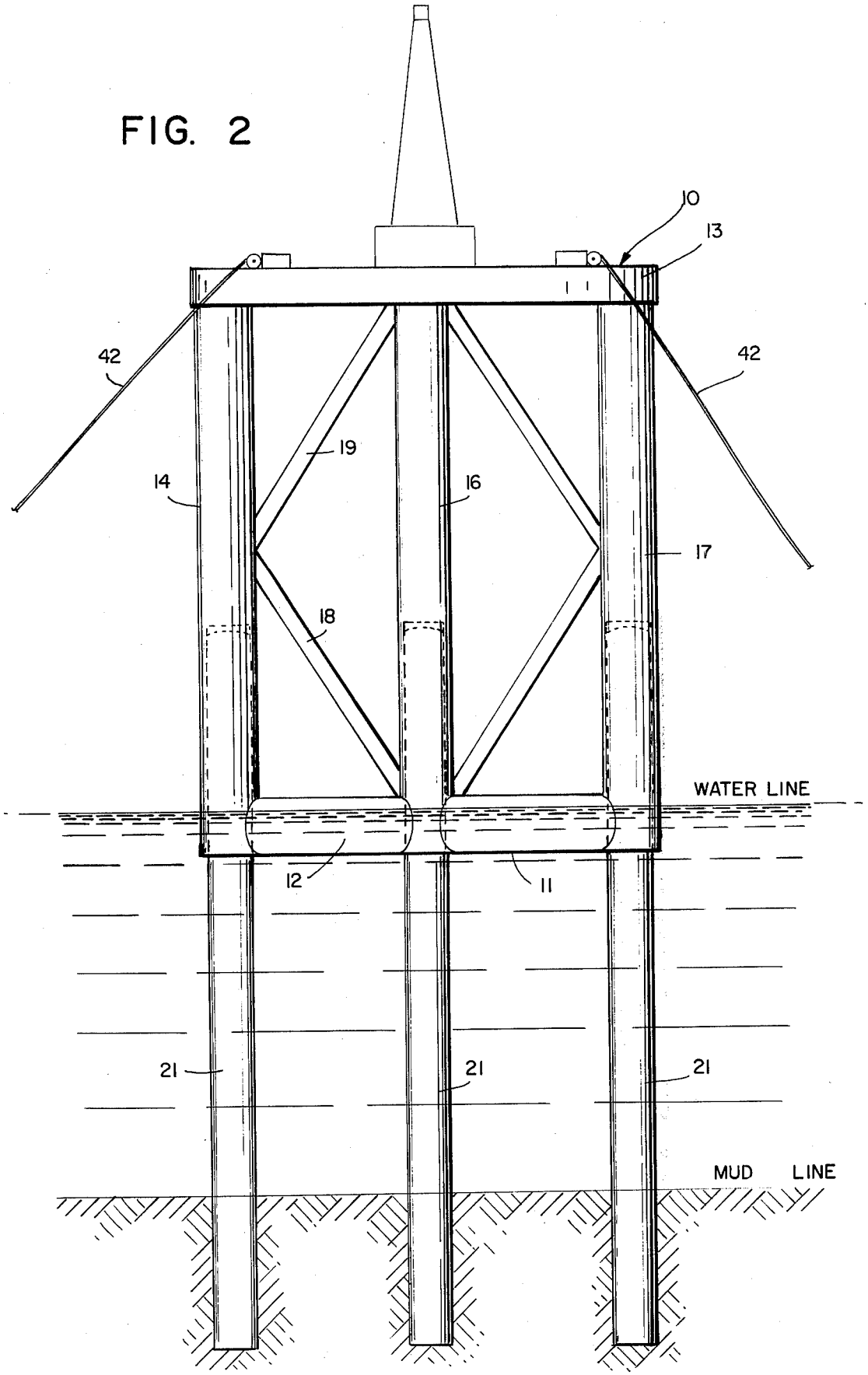
FIG. 2 is similar to FIG. 1, showing the vessel with anchoring legs lowered.

As the platform 10 is conveyed or floated to a drilling site, and as shown in FIG. 2, temporary anchor lines 42 are made fast to anchors prepositioned about the ocean floor. The platform 10 will thus be maintained in a relatively static position above the site at which it is to be submerged.

Air control valves 36 in the leg upper end are opened to controllably release the pressurized air from the closed caisson. As this internal pressure is released, and after leg 21 has been released from guide column 14, the leg will sink downwardly through the column, being guided by the latter in substantially vertical alignment.

Leg 21 is of course of sufficient length that it will be long enough to enter the unconsolidated substrate and reach a desired depth of the latter. With the hull 11 still anchored and in the floating position, all three or more foundation legs are lowered to enter the substrate in a substantially vertical attitude and sink of their own weight to a desired level. The embedding operation can be aided at this point by the addition of a ballast material to the legs by way of conduit 43 and valve 44. Such material would preferably take the form of water which is introduced to annulus 31 to add additional weight to the leg itself.

With the three legs 21 partially embedded in a substantially vertical alignment, they will now act as a multimember upstanding guide for marine platform 10 as the latter is progressively lowered by filling of the ballast tanks. The platform 10 will controllably descend to the ocean floor depending on the flow rate of, and degree of ballast admitted to its tanks. Eventually however it will reach the point where the bottom of hull 10 is near the soil-water interface.

Because of the fluidized consistency of the substrate, the vessel may be ballasted to a suitable penetration of the bottom. However, the desired elevation of the platform can be attained by proper adjustment of the ballast system so that the vessel will sink only the desired amount such that deck 13 remains a predetermined distance above the water level.

Figure 3:
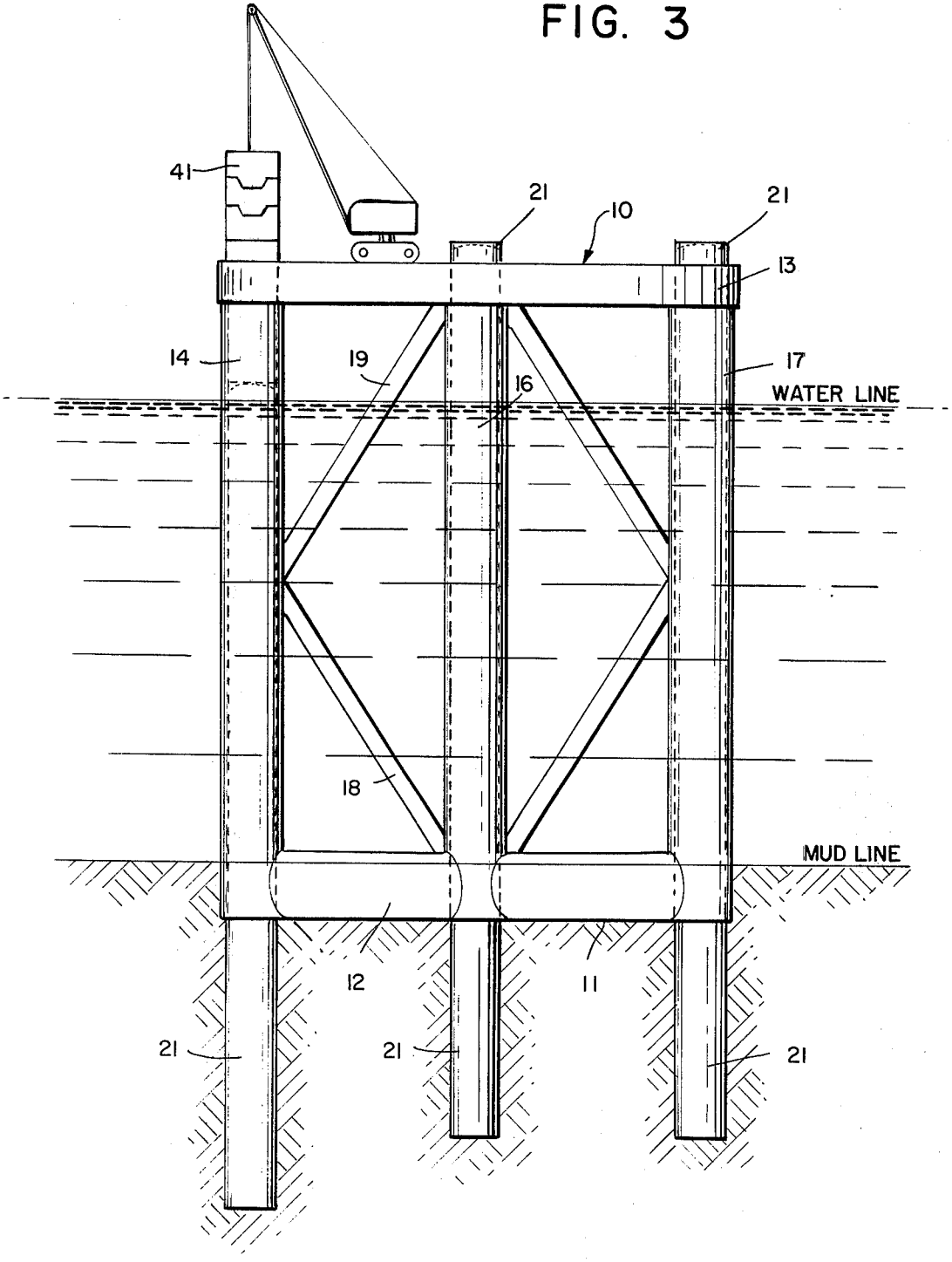
FIG. 3 illustrates the vessel in a submerged condition and anchored to the ocean floor.
Figure 4:
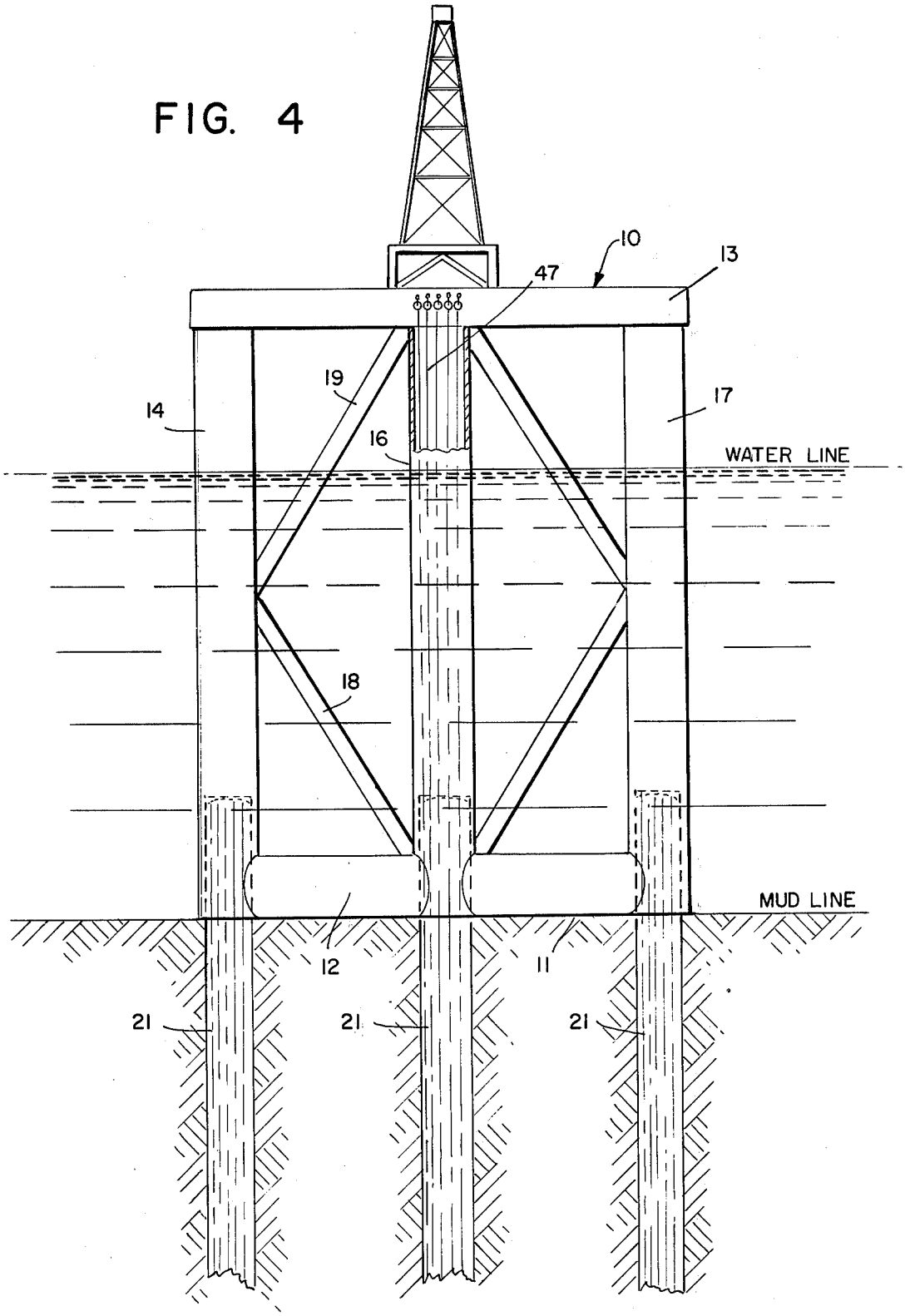
FIG. 4 is similar to FIG. 3, showing a part of the vessel in cross section.

With the vessel 10 so positioned at or adjacent to the ocean floor, the respective foundation legs 21 can be further lowered into the substrate. This is achieved through the facility of further jetting and/or evacuation of the leg interior 23 by withdrawal of fluidized substrate through conduit 37. When relatively consolidated strata has been reached, leg 21 can be forced further into the bottom by the application of weight to the upper end. In the instance of the latter, and as shown in FIG. 3, a series of weight elements 41 are progressively added to the leg upper end whereby to controllably embed the leg to a point where further progress is resisted, or to the desired penetration of the leg.

If the desired axial load capacity is not developed when caisson 21 reaches the desired penetration, additional axial load capability can be provided by driving piling through the annulus of the caisson around the periphery of the caisson. If piles are not required well conductor pipes would be driven through said sleeves to provide protection to the wells from the sliding soils. If piles are required they would be grouted into the sleeves to provide a connection suitable to transmit axial loads from the caisson to the piles.

Vessel 10, now properly leveled by the adjustment of the various ballast tanks, and can be fastened to each of the foundation legs. Such fastening is achieved through any of several known means, including grouting the leg to the hull. However, such fastening can also be achieved through a mechanical connection whereby to immobilize the vessel with respect to the embedded leg.

With the various legs now fully embedded into the bottom and the platform fixedly engaged thereto, deck 13 will be in a position to permit a drilling and producing operation. To aid in the latter, cover plates at the top of caisson(s) 25 can be removed to facilitate the insertion of piles and/or well conductors 47 down through the leg so that the said conductors will be protected during the drilling operation.

Other modifications and variations of the invention as hereinbefore set forth may be made without departing from the spirit and scope thereof, and therefore, only such limitations should be imposed as are indicated in the appended claims.

I claim:

1. A marine vessel (10) adapted to be fixedly anchored on the floor of a body of water, which floor is characterized by an unconsolidated substrate, said vessel having a controlled buoyancy hull (11), a superstructure extending upwardly from said hull and including upstanding support columns (14, 16 and 17) adapted to support a deck (13) above and spaced from said hull, at least one foundation leg (21) guidably positioned within a support column of said superstructure, said leg being adapted for longitudinal movement within said column whereby to be controllably retracted upwardly into said hull or extended downwardly therefrom to enter the substrate beneath said hull, said foundation leg comprising an elongated cylindrical member defining an internal compartment (23) having an access opening at the lower end thereof, and having substantially liquid tight walls, a jetting system carried on said marine vessel including conduit means having one end communicated with a pressurized source of a jetting fluid, and having discharge apertures (27) at the other end thereof disposed about said access opening for directing high pressure streams of jetting fluid into the substrate beneath the foundation leg as the latter is lowered into said substrate and elongated conduit (37) extending downwardly through said foundation leg and terminating adjacent to said access opening (24) for removing substrate which has been fluidized, from said internal compartment.

2. In an apparatus as defined in claim 1 including; leg engaging means on said vessel operable to releasably engage a foundation leg.

3. In an apparatus as defined in claim 1 wherein said support column includes; means therein to slidably guide said elongated cylindrical foundation leg therethrough.

4. In an apparatus as defined in claim 1 wherein said foundation leg includes; an outer shell defining a peripheral wall and an inner shell spaced therefrom, to define an annulus therebetween extending for the length of said leg.

5. In an apparatus as defined in claim 6 including; spacer means interposed between said inner and outer walls in said annulus to maintain said annulus.

6. In an apparatus as defined in claim 1 wherein said foundation leg includes; a top cover removably connected thereto to form an enclosure for said internal compartment.

7. In an apparatus as defined in claim 1 wherein said access opening at the lower end of said foundation leg is divided into peripheral segments, each segment being in communication with a portion of said jetting system whereby jetting fluid can be selectively discharged from discrete segments into the substrate as required.

8. In an apparatus as defined in claim 1 wherein said foundation leg includes; means for introducing pressurized air into the upper end of said internal compartment for evacuating materials from the latter.

9. In an apparatus as defined in claim 1 wherein said foundation leg includes; means at the upper end thereof adapted to receive a weighted member for embedding said leg downwardly into the substrate.

* * * * *